US011367987B1

(12) United States Patent
Li

(10) Patent No.: US 11,367,987 B1
(45) Date of Patent: Jun. 21, 2022

(54) CONNECTOR ASSEMBLY AND INSTALLATION METHOD THEREOF

(71) Applicant: FaYeung Lighting CO,. LTD, Dongguan (CN)

(72) Inventor: Zhaoyuan Li, Dongguan (CN)

(73) Assignee: FAYEUNG LIGHTING CO,. LTD, Dongguan (CN)

( * ) Notice: Subject to any disclaimer, the term of this patent is extended or adjusted under 35 U.S.C. 154(b) by 0 days.

(21) Appl. No.: 17/168,520

(22) Filed: Feb. 5, 2021

(30) Foreign Application Priority Data

Jan. 27, 2021 (CN) ..... 202110110924.7

(51) Int. Cl.
*H01R 24/84* (2011.01)
*H01R 103/00* (2006.01)
*A47G 33/06* (2006.01)

(52) U.S. Cl.
CPC ..... *H01R 24/84* (2013.01); *A47G 33/06* (2013.01); *H01R 2103/00* (2013.01)

(58) Field of Classification Search
CPC .... H01R 24/84; H01R 25/00; H01R 2103/00; A47G 33/06
USPC ..... 439/284
See application file for complete search history.

(56) References Cited

U.S. PATENT DOCUMENTS 2,124,207 A * 7/1938 Neesen ..... H01R 24/84 439/284
3,054,024 A * 9/1962 Van Dillen ..... H05K 7/023 174/541
4,089,579 A * 5/1978 Steinbach ..... H01R 13/6273 439/353
5,800,196 A * 9/1998 Rudoy ..... H01R 24/84 439/284
7,599,617 B2 * 10/2009 Tokiwa ..... H04N 5/23209 439/546
9,774,139 B1 * 9/2017 Dominique ..... H01R 13/635
10,118,574 B2 * 11/2018 Dietrich ..... H01R 31/005
10,404,004 B2 * 9/2019 Fuda ..... H01R 13/44
2006/0094281 A1 * 5/2006 Dang ..... H01R 13/6275 439/352
2009/0046481 A1 * 2/2009 Li ..... F21S 4/10 362/653
2012/0238120 A1 * 9/2012 Huang ..... H01R 13/514 439/284

(Continued)

*Primary Examiner* — Harshad C Patel
(74) *Attorney, Agent, or Firm* — WPAT, PC

(57) ABSTRACT

A connector assembly includes a male connector and a female connector matched with the male connector; the female connector includes a female connector housing and female connector copper terminals; a side surface of the female connector housing has a first wiring hole; an upper part of the female connector housing has sockets corresponding to the female connector copper terminals; the upper part of the female connector housing has slots; the female connector housing has a first installation portion; the male connector includes a male connector housing and male connector copper terminals; a side surface of the male connector housing has a second wiring hole; a bottom part of the male connector has pillars matched with the slots; the male connector has a second installation portion; the male connector copper terminals extend outwardly from the male connector housing and connects the female connector copper terminals.

10 Claims, 4 Drawing Sheets

(56) References Cited

U.S. PATENT DOCUMENTS

| | | | | |
|---|---|---|---|---|
| 2015/0214682 | A1* | 7/2015 | Tsai | H01R 25/003<br>174/72 C |
| 2016/0093973 | A1* | 3/2016 | Hirano | H01R 13/60<br>439/284 |
| 2018/0202619 | A1* | 7/2018 | Dedene | F21V 23/06 |
| 2019/0115688 | A1* | 4/2019 | Oishi | H01R 43/005 |

* cited by examiner

CONNECTOR ASSEMBLY AND INSTALLATION METHOD THEREOF

TECHNICAL FIELD

The invention relates to the field of connector technology, and more particularly to a connector assembly convenient for multi-section connection.

DESCRIPTION OF RELATED ART

In the process of assembly and installation of a Christmas tree, the Christmas tree includes a tree pole, branches of the Christmas tree and lightings hanged on the branches. Since the Christmas tree is relatively large and high, the lightings on the Christmas tree are divided into several sections from bottom to top for installation. At present, the lightings on the Christmas tree are connected through an ordinary relay connector assembly and are lighted by power. However, resulting from a dense arrangement of components on the Christmas tree, it is difficult to install the ordinary relay connector assembly in an actual circuit connection, so that a lot of time is wasted during the process of assembly and installation, which needs to be improved.

SUMMARY

The objective of the invention is to provide a connector to solve the problem mentioned above.

In order to achieve the above objective, the following technical solutions are provided in the invention:

A connector includes a male connector and a female connector matched with the male connector; wherein the female connector includes a female connector housing and female connector copper terminals installed in the female connector housing, a side surface of the female connector housing is provided with a first wiring hole, an upper part of the female connector housing is provided with sockets corresponding to the female connector copper terminals, the upper part of the female connector housing is further provided with slots, and the female connector housing is provided with a first installation portion with an opening downward; and wherein the male connector includes a male connector housing and male connector copper terminals installed in the male connector housing. a side surface of the male connector housing is provided with a second wiring hole, a bottom part of the male connector is provided with pillars matched with the slots, the male connector is provided with a second installation portion with an opening upward, the male connector copper terminals extend outwardly from the bottom part of the male connector housing and is configured for being matched with the female connector copper terminals.

In a further description of the invention, wherein a bottom part of the female connector housing is provided with a bottom cover, a number of the female connector copper terminals is two and the two female connector copper terminals are symmetrically installed on the bottom cover, the bottom cover is fitted onto the female connector housing and locked by screws for fixing; wherein an upper part of the male connector housing is provided with an upper cover, a number of the male connector copper terminals is two and the two male connector copper terminals are symmetrically installed on the upper cover, the upper cover is fitted onto the male connector housing and locked by screws for fixing.

In a further description of the invention, the first installation portion includes a first installing hole and an upper limiting protuberant ring arranged on a top of the first installing hole, and an inner wall of the first installing hole is provided with a first limiting protrusion; wherein the second installation portion includes a second installing hole and a lower limiting protuberant ring arranged on a bottom of the second installing hole, and an inner wall of the second installing hole is provided with a second limiting protrusion.

In a further description of the invention, a center of the bottom cover is provided with a lower guide hole corresponding to the first installing hole, and a center of the upper cover is provided with an upper guide hole corresponding to the second installing hole.

In a further description of the invention, a number of the slots is two, and a number of the pillars is two.

In a further description of the invention, the slots and the pillars are of fool-proof designs.

An installation method of a connector includes the following installation steps:

1) selecting one the female connector and one the male connector respectively as a base female connector and a base male connector, connecting a power supply wire into the first wiring hole of the base female connector, and connecting a first electrical connection wire into at least one of the first wiring hole of the base female connector and the second wiring hole of the base male connector;

2) selecting one the female connector and one the male connector respectively as a relay female connector and a relay male connector, connecting the relay female connector and the relay male connector by an electrical wire whose two ends respectively enter into the first wiring hole of the relay female connector and the second wiring hole of the relay male connector, and connecting a second electrical connection wire into at least one of the first wiring hole of the relay female connector and the second wiring hole of the relay male connector; wherein the relay female connector, the relay male connector, the electrical wire and the second electrical connection wire constitute a relay connector assembly;

3) preparing a plurality of connecting pipes and at least one the relay connector assembly according to an actual need; and;

4) arranging the plurality of connecting pipes sequentially in a direction from bottom to top, installing the base female connector at an upper end of a bottom-most connecting pipe of the plurality of connecting pipes through the first installation portion of the base female connector, and connecting one of the at least one relay connector assembly with the base female connector and a penultimate connecting pipe of the plurality of connecting pipes arranged in the direction from bottom to top; wherein the relay male connector of the one of the at least one relay connector assembly is connected with the base female connector and connects a lower end of the penultimate connecting pipe by the second installation portion, the relay female connector of the one of the at least one relay connector assembly connects an upper end of the penultimate connecting pipe by the first installation portion, a top-most one of the at least one the relay connector assembly in the direction from bottom to top is connected with the base male connector by the relay female connector of the top-most one, and the other of the at least one the relay connector assembly, if exists, is/are sequentially connected upwardly in the direction to achieve the purpose of sequentially connecting the plurality of connecting pipes.

In a further description of the invention, each of the first wiring hole of the base female connector and the second wiring hole of the base male connector has a first electrical connection wire connected therein.

In a further description of the invention, the second wiring hole of the relay male connector has a second electrical connection wire connected therein.

In a further description of the invention, each of the plurality of connecting pipes is a hollow pipe, upper and lower ends of a side surface of a bottom-most hollow pipe as the bottom-most connecting pipe are respectively provided with through holes, and the power supply wire enters the bottom-most hollow pipe from the through hole at the upper end of the bottom-most hollow pipe and exposes out from the through hole at the lower end of the bottom-most hollow pipe to connect with a power supply socket.

The beneficial effects of the invention can be achieved as follows:

In this invention, the female connector and the male connector adopt a structure of up-down plug-in, and the wiring holes are disposed on side surfaces to connecting wires. In the process of connecting the Christmas tree lightings, the Christmas tree is connected by several connecting pipes from bottom to top, and several lightings are hung on the Christmas tree from bottom to top. Therefore, the female connector and the male connector can be respectively connected between the several connecting pipes, the first installation portion of the female connector and the second installation portion of the male connector are respectively used to connect with the upper and lower ends of the connecting pipes, and the first wiring hole and the second wiring hole are used to connect with the electric wire for power supply. The connection is performed before the installation process of Christmas tree, so that the electric wires will not be disordered. Moreover, the power supply is connected through the design of the power supply wire on the lowest mother base, and power supply wire is designed at the bottommost of the female connector and connected with the power supply, and the installation method is simple.

DETAILED DESCRIPTION OF EMBODIMENTS

Figure 1:
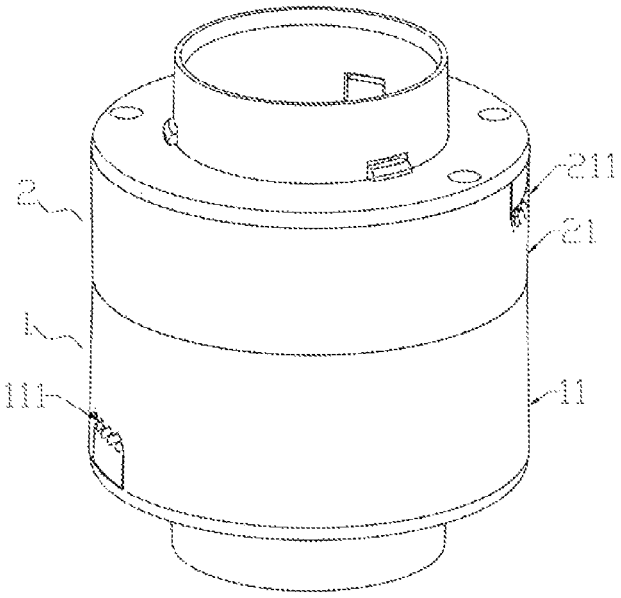
FIG. 1 is a schematic view of an overall structure of a connector assembly according to an embodiment of the invention.
Figure 2:
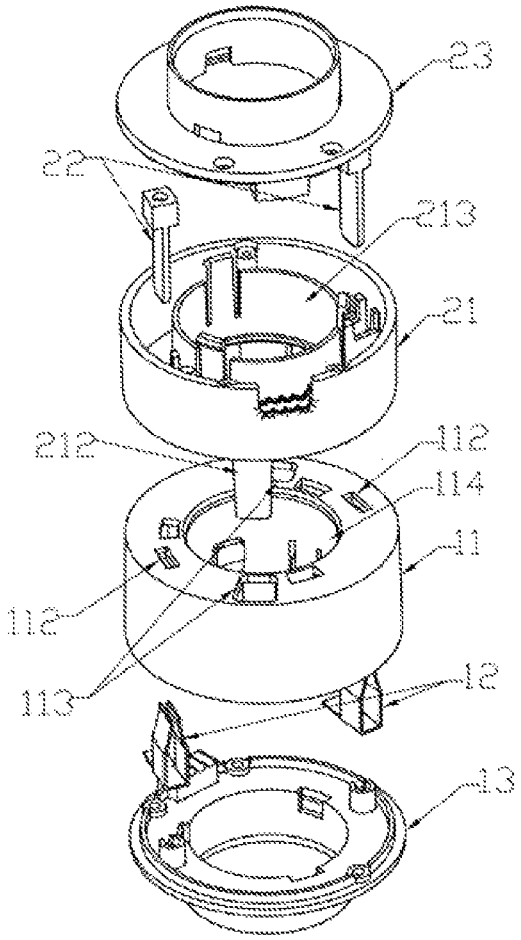
FIG. 2 is a schematic exploded structural view of the connector assembly according to the embodiment of the invention.
Figure 3:
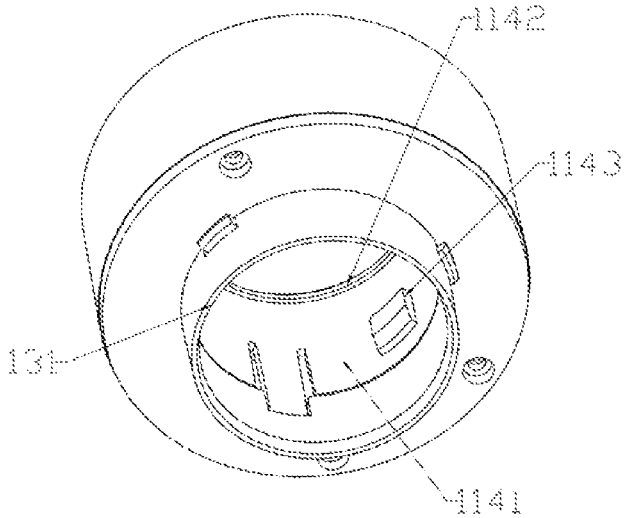
FIG. 3 is a schematic structural view of a female connector according to the embodiment of the invention.
Figure 4:
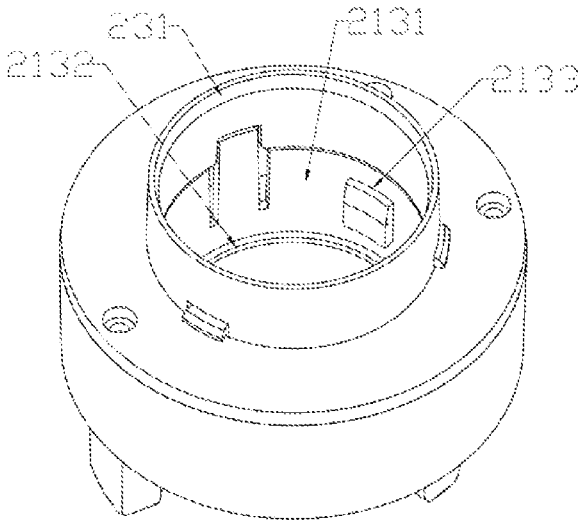
FIG. 4 is a schematic structural view of a male connector according to the embodiment of the invention.
Figure 5:
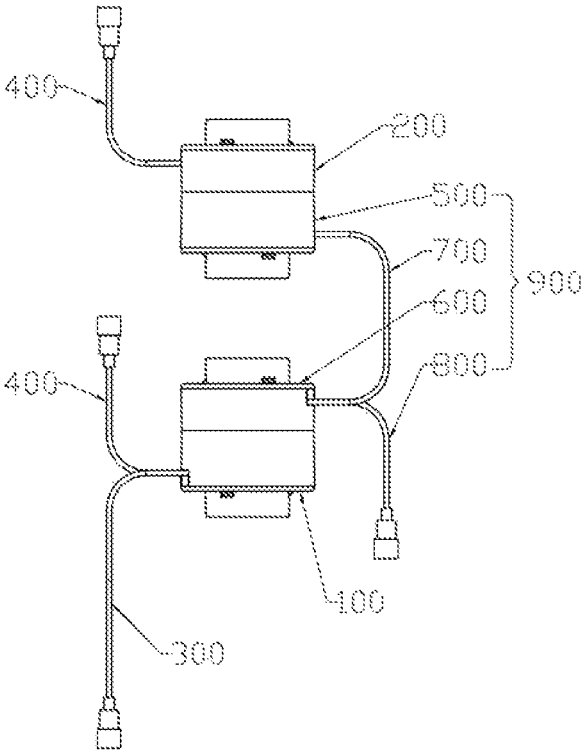
FIG. 5 is a schematic structural view showing a connection among a base female connector, a base male connector and a relay connector assembly according to an embodiment of the invention.

The invention is further described in combination with the drawings.

As shown in FIGS. 1-5, a new type of connector assembly includes a male connector 2 and a female connector 1 which can be matched with the male connector 2. The female connector 1 includes a female connector housing 11 and female connector copper terminals 12 installed in the female connector housing 11. A side surface of the female connector housing 11 is provided with a first wiring hole 111. An upper part of the female connector housing 11 is provided with sockets 112 corresponding to the female connector copper terminals 12; and the upper part of the female connector housing 11 is further provided with slots 113. The female connector housing 11 is provided with a first installation portion 114 with an opening downward. The male connector 2 includes a male connector housing 21 and male connector copper terminals 22 installed in the male connector housing 21. A side surface of the male connector housing 21 is provided with a second wiring hole 211. A bottom part of the male connector 2 is provided with pillars 212 matched with the slots 113. The male connector 2 is provided with a second installation portion 213 with an opening upward; and the male connector copper terminals 22 extend outwardly from the bottom part of the male connector housing 21 and matched with the female connector copper terminals 12. The male connector 2 is inserted into the slots 113 of the female connector 1 through the pillars 212 from top to bottom for matching. The male connector copper terminals 22 is inserted into the female connector copper terminals 12 for circuit connection, and the first wiring hole 111 of the female connector 1 and the second wiring hole 211 of the male connector 2 are respectively arranged on side surfaces for connecting the wire 700; and the first installation portion 114 and the second installation portion 213 are used for assembling and connecting the Christmas tree.

In this invention, a bottom part of the female connector housing 11 is provided with a bottom cover 13. A number of the female connector copper terminals 12 is two and the two female connector copper terminals are symmetrically installed on the bottom cover 13. The bottom cover 13 is fitted onto the female connector housing 11 and locked by screws for fixing. An upper part of the male connector housing 21 is provided with an upper cover 23. A number of the male connector copper terminals 22 is two and the two male connector copper terminals are symmetrically installed on the upper cover 23. The upper cover 23 is fitted onto the male connector housing 21, and locked by screws for fixing.

The first installation portion 114 includes a first installing hole 1141 and an upper limiting protuberant ring 1142 arranged on a top of the first installing hole 1141. An inner wall of the first installing hole 1141 is provided with a first limiting protrusion 1143. The second installation portion 213 includes a second installing hole 2131 and a lower limiting protuberant ring 2132 arranged on a bottom of the second installing hole 2131; and an inner wall of the second installing hole 2131 is provided with a second limiting protrusion 2133. The tree trunk of the Christmas tree is connected by several connecting pipes 1000. Side walls of the upper and lower ends of the connecting pipe 1000 are respectively provided with positioning slots matched with the first limiting protrusion 1143 and the second limiting protrusion 2133. The upper and lower ends of the connecting pipe 1000 respectively abut against the upper limiting protuberant ring 1142 and the lower limiting protuberant ring 2132 for position limiting. The female connector 1 is sleeved at the upper end of the connecting pipe 1000 through the first installing hole 1141 and is matched and positioned with the positioning slots through the first limiting protrusion 1143. The male connector 2 is sleeved at the lower end of the connecting pipe 1000 through the second installing hole 2131, and is matched and positioned with the positioning slots through the second limiting protrusion 2133, so as to realize the assembly between the female connector 1, the male connector 2 and the connecting pipe 1000.

A center of the bottom cover 13 is provided with a lower guide hole 131 corresponding to the first installing hole

1141. A center of the upper cover 23 is provided with an upper guide hole 231 corresponding to the second installing hole 2131; and the design of the lower guide hole 131 and the upper guide hole 231 can improve the stability of assembly and reduce the difficulty of assembly.

A number of the slots 113 is two, and a number of the pillars 212 is two, and the slots 113 and the pillars 212 are of fool-proof designs, and the two slots 113 are designed in different directions, so as to form a fool-proof structure and prevent an installation in a wrong direction.

The installation method of the new type of connector includes the following installation steps:

1), selecting one the female connector 1 and one the male connector 2 respectively as a base female connector 100 and a base male connector 200, connecting a power supply wire 300 into the first wiring hole 111 of the base female connector 100, and connecting a first electrical connection wire 400 into at least one of the first wiring hole 111 of the base female connector 100 and the second wiring hole 211 of the base male connector 200. The first electrical connection wire 400 is used for connecting with the lightings for power supply;

2) Selecting one the female connector 1 and one the male connector 2 respectively as a relay female connector 500 and a relay male connector 600, connecting the relay female connector 500 and the relay male connector 600 by a connecting wire 700, whose two ends respectively enter into the first wiring hole 111 of the relay female connector 500 and the second wiring hole 211 of the relay male connector 600, and connecting a second electrical connection wire 800 into at least one of the first wiring hole 111 of the relay female connector 500 and the second wiring hole 211 of the relay male connector 600, wherein the relay female connector 500, the relay male connector 600, the connecting wire 700 and the second electrical connection wire 800 constitute a relay connector assembly 900; the second electrical connection wire 800 is the same as the first electrical connection wires 400, which is used for connecting with the lightings for power supply;

3) Preparing several connecting pipes 1000 and and at least one the relay connector assembly according to an actual need; and 4) Arranging the several connecting pipes 1000 in a direction from bottom to top, installing the base female connector 100 at an upper end of a bottom-most connecting pipe 1000 of the several connecting pipes 1000 through the first installation portion 114 of the base female connector 100, and connecting one of the at least one relay connector assembly 900 with the base female connector 100 and a penultimate connecting pipe of the several connecting pipes 1000 arranged in the direction from bottom to top, wherein the relay male connector 600 of the one of the at least one relay connector assembly 900 is connected with the base female connector 100 and connects a lower end of the penultimate connecting pipe 1000 by the second installation portion 213, the relay female connector 500 of the at least one relay connector assembly 900 connects an upper end of the penultimate connecting pipe 1000 by the first installation portion 114, and a top-most one of the at least one the relay connector assembly 900 in the direction from bottom to top is connected with the base male connector 200 by the relay female connector 500 of the top-most one, and the other of the at least one the relay female connector assembly, if exits, is/are sequentially connected upwardly in the direction to achieve the purpose of sequentially connecting the several connecting pipes 1000.

In this embodiment, each of the first wiring hole 111 of the base female connector 100 and the second wiring hole 211 of the base male connector 200 has a first electrical connection wire 400 connected therein, and the second wiring hole 211 of the relay male connector 600 is connected with the second electrical connection wire 800. Therefore, the base female connector 100 and the base male connector 200 can respectively be connected with the lightings through the first electrical connection wires 400 for power supply. When one relay connector assembly 900 is added, an additional second electrical connection wire 800 can be connected to the lightings for power supply. The power supply wire 300, the connecting wire 700, the first electrical connection wire 400 and the second electrical connection wire 800 can be assembled before they are assembled to the Christmas tree. When they are assembled to the Christmas tree, it only needs to connect the power supply wire 300 and connect the first electrical connection wire 400 and the second electrical connection wire 800 to the interface of the lightings.

Each of the several connecting pipes 1000 is a hollow pipe, the upper and lower ends of a side surface of a bottom-most hollow pipe as the bottom-most connecting pipe are respectively provided with through holes 1001, and the power supply wire 300 enters the bottom-most hollow pipe from the through hole 1001 at the upper end of the bottom-most hollow pipe and exposes out from the through hole 1001 at the lower end of the bottom-most hollow pipe to connect with a power supply socket.

Figure 6:
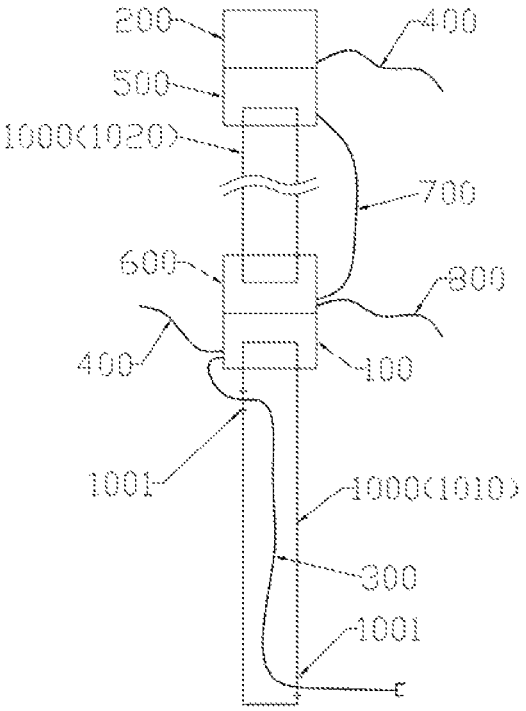
FIG. 6 is a schematic assembled view associated with a use of a relay connector assembly according to an embodiment of the invention.

FIG. 6 is a schematic assembled view associated with the connection mode of a relay connector assembly 900 with two connecting pipes 1000. It is shows a first connecting pipe 1010 and a second connecting pipe 1020 from bottom to top. The base female connector 100 is installed on the upper end of the first connecting pipe 1010, the relay connector assembly 900 is inserted into the base female connector 100 through the relay male connector 600, and the relay female connector 500 of the relay connector assembly 900 is installed on the upper end of the second connecting pipe 1020, The base male connector 200 is inserted into the relay female connector 500, and the power supply wire 300 on the base female connector 100 enters into the first connecting pipe 1010 from the upper through hole 1001, extends out from the lower through hole 1001, and connects the power supply interface, so as to hide the power supply wire 300 in the first connecting pipe 1010. The first electrical connection wire 400 and the second electrical connection wire 800 are respectively connected with the interfaces of the lightings for power supply. According to the height of the Christmas tree, the assembly can be completed by increasing the number of connecting pipe 1000 and relay connector assembly 900.

The above description does not limit the technical scope of the invention. Any modification, equivalent substitution and improvement made to the above embodiments according to the technical essence of the invention are all included in the scope of the technical solution of the invention.

What is claimed is:

1. A connector assembly, comprising a male connector and a female connector matched with the male connector;

wherein the female connector comprises a female connector housing and female connector copper terminals installed in the female connector housing, a side surface of the female connector housing is provided with a first wiring hole, an upper part of the female connector housing is provided with sockets corresponding to the female connector copper terminals, the upper part of the female connector housing is further provided with slots, and the female connector housing is provided with a first installation portion with an opening downward; and wherein the male connector comprises a male connector housing and male connector copper terminals installed in the male connector housing, a side surface of the male connector housing is provided with a second wiring hole, a bottom part of the male connector is provided with pillars matched with the slots, the male connector is provided with a second installation portion with an opening upward, the male connector copper terminals extend outwardly from the bottom part of the male connector housing and is configured for being matched with the female connector copper terminals.

2. The connector assembly as claimed in claim 1, wherein a bottom part of the female connector housing is provided with a bottom cover, a number of the female connector copper terminals is two and the two female connector copper terminals are symmetrically installed on the bottom cover, the bottom cover is fitted onto the female connector housing and locked by screws for fixing;

wherein an upper part of the male connector housing is provided with an upper cover, a number of the male connector copper terminals is two and the two male connector copper terminals are symmetrically installed on the upper cover, the upper cover is fitted onto the male connector housing and locked by screws for fixing.

3. The connector assembly as claimed in claim 2, wherein the first installation portion comprises a first installing hole and an upper limiting protuberant ring arranged on a top of the first installing hole, and an inner wall of the first installing hole is provided with a first limiting protrusion;

wherein the second installation portion comprises a second installing hole and a lower limiting protuberant ring arranged on a bottom of the second installing hole, and an inner wall of the second installing hole is provided with a second limiting protrusion.

4. The connector assembly as claimed in claim 3, wherein a center of the bottom cover is provided with a lower guide hole corresponding to the first installing hole, and a center of the upper cover is provided with an upper guide hole corresponding to the second installing hole.

5. The connector assembly as claimed in claim 1, wherein a number of the slots is two, and a number of the pillars is two.

6. The connector assembly as claimed in claim 1, wherein the slots and the pillars are of fool-proof designs.

7. An installation method of the connector assembly as claimed in claim 1, comprising the following installation steps:

1) selecting one the female connector and one the male connector respectively as a base female connector and a base male connector, connecting a power supply wire into the first wiring hole of the base female connector, and connecting a first electrical connection wire into at least one of the first wiring hole of the base female connector and the second wiring hole of the base male connector;

2) selecting one the female connector and one the male connector respectively as a relay female connector and a relay male connector, connecting the relay female connector and the relay male connector by an electrical wire whose two ends respectively enter into the first wiring hole of the relay female connector and the second wiring hole of the relay male connector, and connecting a second electrical connection wire into at least one of the first wiring hole of the relay female connector and the second wiring hole of the relay male connector; wherein the relay female connector, the relay male connector, the electrical wire and the second electrical connection wire constitute a relay connector assembly;

3) preparing a plurality of connecting pipes and at least one the relay connector assembly according to an actual need; and 4) arranging the plurality of connecting pipes sequentially in a direction from bottom to top, installing the base female connector at an upper end of a bottom-most connecting pipe of the plurality of connecting pipes through the first installation portion of the base female connector, and connecting one of the at least one relay connector assembly with the base female connector and a penultimate connecting pipe of the plurality of connecting pipes arranged in the direction from bottom to top; wherein the relay male connector of the one of the at least one relay connector assembly is connected with the base female connector and connects a lower end of the penultimate connecting pipe by the second installation portion, the relay female connector of the one of the at least one relay connector assembly connects an upper end of the penultimate connecting pipe by the first installation portion, a top-most one of the at least one the relay connector assembly in the direction from bottom to top is connected with the base male connector by the relay female connector of the top-most one, and the other of the at least one the relay connector assembly, if exists, is/are sequentially connected upwardly in the direction to achieve the purpose of sequentially connecting the plurality of connecting pipes.

8. The installation method as claimed in claim 7, wherein each of the first wiring hole of the base female connector and the second wiring hole of the base male connector has a first electrical connection wire connected therein.

9. The installation method as claimed in claim 7, wherein the second wiring hole of the relay male connector has a second electrical connection wire connected therein.

10. The installation method as claimed in claim 7, wherein each of the plurality of connecting pipes is a hollow pipe, upper and lower ends of a side surface of a bottom-most hollow pipe as the bottom-most connecting pipe are respectively provided with through holes, and the power supply wire enters the bottom-most hollow pipe from the through hole at the upper end of the bottom-most hollow pipe and exposes out from the through hole at the lower end of the bottom-most hollow pipe to connect with a power supply socket.

* * * * *